United States Patent [19]

Stevens

[11] 4,422,912

[45] Dec. 27, 1983

[54] METHOD AND APPARATUS FOR RECOVERING METALS FROM METAL RICH SOLUTIONS

[76] Inventor: William J. Stevens, 23/25 Woodstock St., Bondi Junction, New South Wales, Australia

[21] Appl. No.: 380,444

[22] Filed: May 20, 1982

[30] Foreign Application Priority Data

Jun. 12, 1981 [AU] Australia ..... PE9272

[51] Int. Cl.[3] ..... C25C 1/20; C25C 7/00

[52] U.S. Cl. ..... 204/109; 204/228; 204/275

[58] Field of Search ..... 204/109, 228, 275

[56] References Cited

U.S. PATENT DOCUMENTS 4,069,127 1/1978 Salemi et al. ..... 204/109

FOREIGN PATENT DOCUMENTS 19690 3/1972 Australia ..... 204/109

69868 12/1975 Australia ..... 204/109

*Primary Examiner*—Richard L. Andrews

*Attorney, Agent, or Firm*—Leydig, Voit, Osann, Mayer and Holt, Ltd.

[57] ABSTRACT

A metal such as silver is recovered from an electrolyte by supply from a holding vessel to a plating cell at a replenishment rate which is automatically reduced when the electrolyte level in the vessel falls below a specified level. While the cell is fed at the reduced rate the cell is operated at a reduced current selected to equate the sum of dissolution from the electrode and metal introduction at the lower replenishment rate. Apparatus for carrying out the method is described.

5 Claims, 1 Drawing Figure

METHOD AND APPARATUS FOR RECOVERING METALS FROM METAL RICH SOLUTIONS

This invention relates to the recovery of metals from metal rich electrolytes.

The invention was developed primarily for use in association with automatic photographic film processors for the extraction of silver from the effluent solution from such processors and is described hereinafter primarily with reference to that use. However it will be appreciated that the invention is applicable generally to electrolytic metal recovery units and not only to units for the recovery of silver.

Two types of recovery units are commonly used in association with film processors, namely, the continuous, or flow through type, and the batch type. In one known form of the continuous type unit, the metal rich solution is fed into the bottom of a plating-out cell and allowed to rise gently through that cell during which progress the metal is electrolytically plated onto electrodes utilizing a low current density. Another known continuous type unit employs agitation of the electrolyte which causes total mixing and may be operated at a somewhat higher current density. In both instances the depleted solution is discharged from the top of the cell. At a cessation of operation the electric supply to the cell is switched off manually, by time clock, or by some other control means when extraction is deemed to be complete.

As a general rule the supply of solution from a film processor is not a constant rate and, indeed depending upon the work load it is customarily intermittent.

Australian Pat. No. 444,212 provides an upstream holding tank to receive the supply from the processor. A metering pump producing flow through the electrolytic cell switches on when the stock in the holding tank is sufficient and off when the stock falls below a preset level. The cell electrodes are switched on and off in concert with the metering pump. That patent thus provides an intermittent supply of feed to, and an intermittent operation of the electrodes in the cell. When the solution is flowing through the cell at a predetermined rate the cell operates at a constant current setting and the electrodes are de-energized when flow ceases.

A disadvantage of that apparatus is that during periods of shut downs, the silver deposit on the cathode dissolves slowly back into the electrolyte.

All modern fixing solutions formulated for use in automatic film processors must be highly concentrated and corrosive enough to the silver salts in the emulsions on the film or paper to dissolve them very quickly during transit through the processor.

This property of the fixing solution is most undesirable for electrolysis in that during the electrolytic extraction process redissolving is taking place and some current is being used to replate those ions which have dissolved as well as those which represent the net gain in metal to the cathode, but while the equipment is switched on, provided that the current is constant and its value set to accord with the dissolving and net gain to the cathode, and such net gain to the cathode is equal to the amount of silver being introduced, a steady state of equilibrium exists and the apparatus is entirely efficient and total extraction should be taking place without any over extraction occurring with its problems of losses through sulphiding.

But a problem arises when the apparatus switches off and there is an absence of current either to plate or equate to the dissolving which is now occurring without check.

All modern fixing solutions will take the silver metal on the cathode back into solution, some more than others. The solution attacks the silver selectively, leaving behind any silver sulphide which is insoluble in the electrolyte. However there are many proprietary brands being used and for different types of films, different types of solutions have been marketed such as the bleach fix used for colour film processing.

This particular solution is extremely corrosive to silver metal and Australian Pat. No. 486,468 is directed to solution of that problem. That patent teaches that if, during period of no flow a low preset holding current is applied to the electrodes sufficient to maintain the silver on the cathode, then problems of overplating may occur while if too low a preset holding current is applied then silver re-dissolves with a loss of yield.

Accordingly, Australian Pat. No. 486,468 proposes automatically and mechanically to separate the electrolyte from the cathode when the cathode is de-energised. Separation is achieved either by automatically pumping the solution out of the cell into a holding tank or by automatically lifting the cathode assembly clear of the solution and by use of self-draining cathodes.

That patent specification mentions sulphiding and spongy deposits occurring if the current is switched off and that the same thing occurs if a preset holding current is applied to the cell to match the dissolution rate when the replenishment of silver rich solution to the electrolytic cell is terminated.

The reason for this state when the current is switched off is that silver dissolves from the cathode and leaves behind the insoluble silver sulphide thereby increasing the proportion of silver sulphide present to the diminishing silver metal thus causing voids and the resulting spongy characteristic of the increasing proportion of loosely adhering silver sulphide.

The increased amount of silver now in solution when the apparatus is switched on is augmented by the introduction of fresh silver bearing solution and the amount of current flowing across the electrodes has been set to extract the silver from the replenishment plus the silver presently dissolving from the cathode and not that which has built up by dissolution while the recovery unit was switched off, so that which has built up remains unextracted and is displaced to waste in the effluent solution.

Alternatively, if a small holding current had been set, when otherwise the apparatus were switched off, sufficient to replate the silver currently dissolving, and silver solution were not being added by replenishment, the holding current would be operating in a cell which was void of silver solution except for that currently dissolving at the cathode interface. That condition is favourable for the formation of hydrogen sulphide gas at the cathode according to Faraday's Law, and this gas combines with the silver immediately being taken into solution to form colloidal silver sulphide in the environment of the cathode deposit. Once again a loose spongy sulphide deposit results with losses as slimes and float slimes in suspension when flow through continues, so that a small holding current in a cell void of silver is not conducive to complete extraction and a good deposit.

Colloidal silver sulphide resists normal methods of filtering and will not show in a qualitative test by litmus or by chemical precipitation and such silver sulphide is almost invariably lost in the recovery operation without its presence, or at least the extent of its presence being realised, although as Australian Patent No. PCT/AU81/00008 teaches the darker colour of the electrolyte will give the indication of sulphiding occurring as the colloidal silver sulphide makes the solution progressively darker as its presence increases. That Patent provides for transparent walls in the Extraction Unit for amongst, other purposes, observing whether this phenomenon is occurring and if so to what extent.

An object of the present invention is to provide a method of and apparatus for metal extraction which avoids at least some of the disadvantages of the prior art and which in preferred embodiments permits a simpler construction of apparatus.

Figure 1:
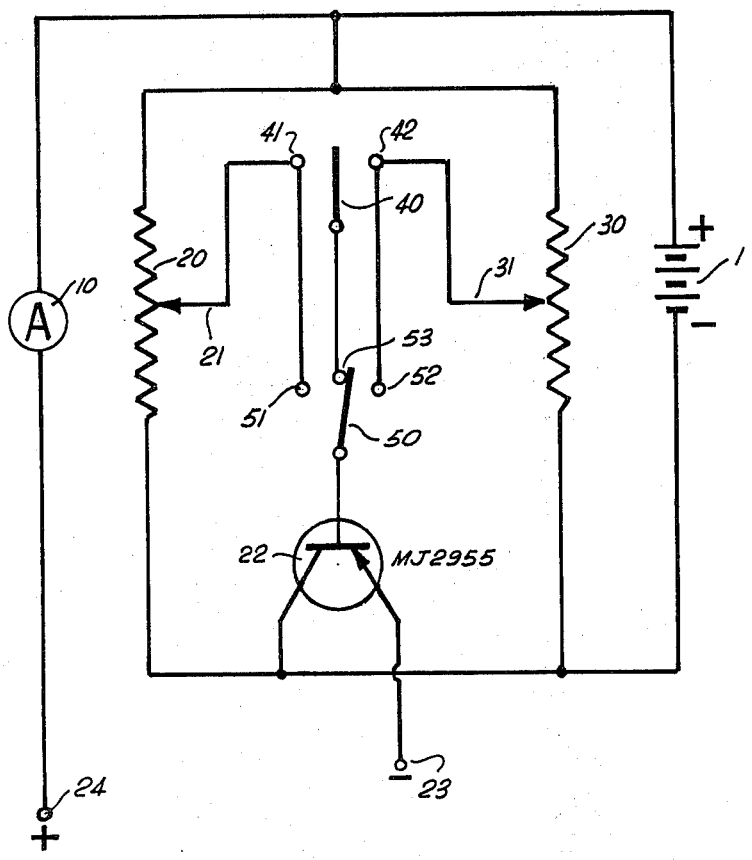
FIG. 1 shows a plating circuit for controlling the plating current.

According to one aspect the invention consists in a method for recovering metal from a metal rich electrolyte solution comprising the steps of:

(a) supplying the solution from a vessel to an electrolytic plating cell at a first feed rate when the solution level in the vessel is greater than a predetermined level and at a slower feed rate when the solution level is below the predetermined level, (b) adjusting the plating current of the cell from a first current when the cell is supplied at the first feed rate to a lower current when the cell is supplied at the slower feed rate.

According to a second aspect the invention consists in apparatus comprising:

an electroplating cell;

means for metering a solution from a holding tank to the cell at a first feed rate when the solution level in the holding tank is above a predetermined level and at a slower feed rate than the first when the solution level is below the predetermined level; and control means to reduce the plating current of the cell from a first value when the cell is fed at the first feed rate to a lower value when the cell is fed at said slower feed rate.

In preferred embodiments of the invention the first feed rate and the first value of plating current are selected for optimum plating efficiency having regard to the nature of the electrolyte and the quantity typically requiring treatment.

The slower feed rate is selected to enable a buffer stock contained in the holding tank below the predetermined level to be fed to the plating cell and the lower current is selected to equate the dissolution rate plus the reduced amount of silver in the replenishment solution.

The buffer stock and slower feed rate are preferably such that feeding at the slower rate may if necessary proceed continuously for several days.

By way of example only, an embodiment of the invention will now be described.

A holding tank is provided in which is held stock of photographic solution from which silver is to be recovered. A main metering pump draws solution from the holding tank for delivery to an electrolytic plating cell. A second metering pump delivers solution from the holding tank to the electrolyte cell at a very much slower rate than the main pump, the combined rates representing the high rate.

If the liquid level in the holding tanks falls below a predetermined level then the main pump is de-energised, for example by a float operated switch.

However the second metering pump is not affected and continues to operate. The main pump is re-energised if the stock in the holding tank is replenished to above the predetermined level.

When the liquid level in the holding tank is such that both pumps are delivering solution to the cell, the current in the electrolytic plating cell is set at a first level having regard to the total amount of silver in the replenishment plus that which is dissolving.

However in the event that the liquid level in the holding tank falls below the predetermined level then the plating current of the cell is automatically switched to a standby level of current selected to equate the sum of the dissolution and the amount of silver being introduced to the cell at the lower replenishment rate.

Switching between two plating currents may be achieved by a separate float operated switch or by a separate set of contacts of the same float operated switch as is used to control the pump.

DETAILED DESCRIPTION OF THE DRAWINGS

With reference to FIG. 1 there is shown a plating circuit comprising a DC power supply 1, for example a battery or rectifier, having its positive terminal connected to a plating terminal 24 in use connected to the positive plating electrode.

The current supply to the negative terminal 23 which in use is connected to the circuit negative electrode is controlled via transistor 22, in the present example a type MJ2955.

The base of transistor 22 is connected, via switch arm 50 which in its normal position is closed with switch contact 53 and via float switch arm 40, either via contact 42 with sliding contact 31 of rheostat 30 or via contact 41 with sliding contact 21 of rheostat 20.

Rheostats 20 and 30 are connected in parallel across the power supply and are set so as to provide either a high current or a low current between electrode terminal 23 and 24 depending on which rheostat is connected by float arm 40 with the base of transistor 22.

Switch arm 50 provides means to override float switch arm 40 to energize transistor 22 rheostat 20 or 30. With switch arm 50 in contact with switch contact 51 or 52 it is possible to select one or other plating current and to register the current flowing through one or other rheostat by means of amp meter 10 which is for preference provided in the circuit.

The apparatus may optionally be provided with switches (not shown in FIG. 1) to deactivate the entire unit in case the holding tank is near to or becoming totally empty or warning devices in case the holding tank is near to overflowing and may be provided with a device indicating whether the apparatus is in normal plating condition or in stand-by plating condition.

Although in the above described embodiment one pump remains in operation while the other is switched into operation when a preset level on the holding tank is exceeded, two pumps of differing metering rates could be instead employed and one could be switched into operation when the other is switched out of operation or one pump which can be operated at two speeds may be used.

Although float switches are used in the embodiment described other means of sensing level and of controlling plating current could be employed without departing from the inventive concept described above.

It will be appreciated that by maintaining a standby flow through the cell while energized at a standby current, both excessive sulphiding and losses caused by dissolution may be avoided and the need to separate electrolyte from the electrodes of the cell is thus avoided.

I claim:

1. A method for recovering metal from a metal rich electrolyte solution comprising the steps of:

(a) flowing the solution from a vessel through a continuously acting electrolytic plating cell at a first feed rate when the solution level in the vessel is greater than a predetermined level and at a lesser feed rate when the solution level is below the predetermined level;

(b) adjusting the plating current of the cell from a first current when the cell is supplied at the first feed rate to a lower current when the cell is supplied at the lesser feed rate.

2. A method according to claim 1 wherein the plating current is automatically switched from the first current to the lower current when the solution level falls below the predetermined level.

3. Apparatus comprising:

an electroplating cell;

means for metering a solution from a holding tank to the cell at a first feed rate when the solution level in the holding tank is above a predetermined level and at a lesser feed rate than the first when the solution level is below the predetermined level; and control means to reduce the plating current of the cell from a first value when the cell is fed at the first feed rate to a lower value when the cell is fed at said lesser feed rate.

4. Apparatus according to claim 3 comprising:

float operated switching means arranged to switch the plating current from a predetermined first value to a predetermined lower value when the solution level in the holding tank falls below the predetermined value.

5. Apparatus according to claim 4 wherein the first feed rate is achieved by two pumps operating simultaneously and the lesser feed rate is achieved by operating only one of them.

* * * * *